United States Patent [19]

Stahlecker

[11] 4,012,810

[45] Mar. 22, 1977

[54] DRAWING SYSTEM ARRANGEMENT FOR SPINNING MACHINES

[75] Inventor: Hans Stahlecker, Sussen, Germany

[73] Assignees: Fritz Stahlecker; Hans Stahlecker, both of Germany

[22] Filed: Apr. 25, 1975

[21] Appl. No.: 571,852

[30] Foreign Application Priority Data

May 9, 1974 Germany ..... 2422422

[52] U.S. Cl. ..... 19/294; 19/295

[51] Int. Cl.[2] ..... D01H 5/56

[58] Field of Search ..... 19/236, 288, 260, 261, 19/281, 282, 294, 295, 272, 266, 267

[56] References Cited

UNITED STATES PATENTS

| | | | |
|---|---|---|---|
| 408,275 | 8/1889 | Tweedale | 19/295 X |
| 2,947,039 | 8/1960 | Rulon-Miller et al. | 19/294 |
| 3,035,314 | 5/1962 | Cotchett | 19/294 |

FOREIGN PATENTS OR APPLICATIONS

| | | | |
|---|---|---|---|
| 1,491,667 | 7/1967 | France | 19/294 |
| 1,047,085 | 12/1958 | Germany | 19/281 |
| 17,613 | 1902 | United Kingdom | 19/282 |

*Primary Examiner*—Dorsey Newton
*Attorney, Agent, or Firm*—Craig & Antonelli

[57] ABSTRACT

A drawing system arrangement for spinning machines, in which there are at least two dies for holding the bottom rollers of the drawing system and the dies are connected by a carrying rod. In the new embodiment, the carrying rod is at least twice as long as the distance between two adjacent dies; the carrying rod is attached directly to the machine frame and supports the dies attached to it in addition to the top roller carrying and loading arm.

9 Claims, 6 Drawing Figures

DRAWING SYSTEM ARRANGEMENT FOR SPINNING MACHINES

The present invention relates to a drawing system arrangement for spinning machines, in which the top roller carrying and loading arms are connected with a carrying rod and in which there are at least two dies which are connected with the carrying rod and which contain the bottom rollers of the drawing system, and which are in a supporting relationship with a die carrier arranged on the machine frame.

It is known practice to attach the carrying rod for the top roller carrying and loading arm to a die or an intermediate member connected with the die. In this case, the length of the carrying rod corresponds to the distance between the bearings of two bottom cylinders. In the known arrangement, each drawing system, or each drawing system group arranged between two bottom cylinder bearings, must be attached separately to the spinning machine. This work is timeconsuming and difficult.

It is the object of the present invention to permit preassembly of a large number of drawing systems and thereby achieve shorter assembly times when setting up a spinning machine.

According to the present invention, this object is solved in that the carrying rod is at least twice as long as the distance between two adjacent dies and in that the carrying rod is attached directly to the machine frame and also carries the dies attached to it, in addition to the top roller carrying and loading arms.

It is now possible to preassemble a large drawing system group by sections. As opposed to the known method of setting up spinning machines, the die is now attached to the carrying rod instead of attaching the carrying rod to the die. The carrying rod preassembled in this manner is then attached directly to the machine frame, with the die also being in a supporting relationship with a die carrier. Since the carrying rod now also supports the die, the die carrier can be dimensioned smaller. In addition, there are also fewer machining steps, as the carrying rod is significantly longer than previously and, for this reason, has only fewer surfaces to be machined. Thus, in addition to reducing the assembly time, the fabrication costs are also reduced.

The above discussed and other objects, features and advantages of the present invention will become more apparent from the following description thereof, when taken in connection with the accompanying drawings, in which FIG. 1 shows an arrangement of a drawing system according to the present invention, on a machine frame;

Figure 1:
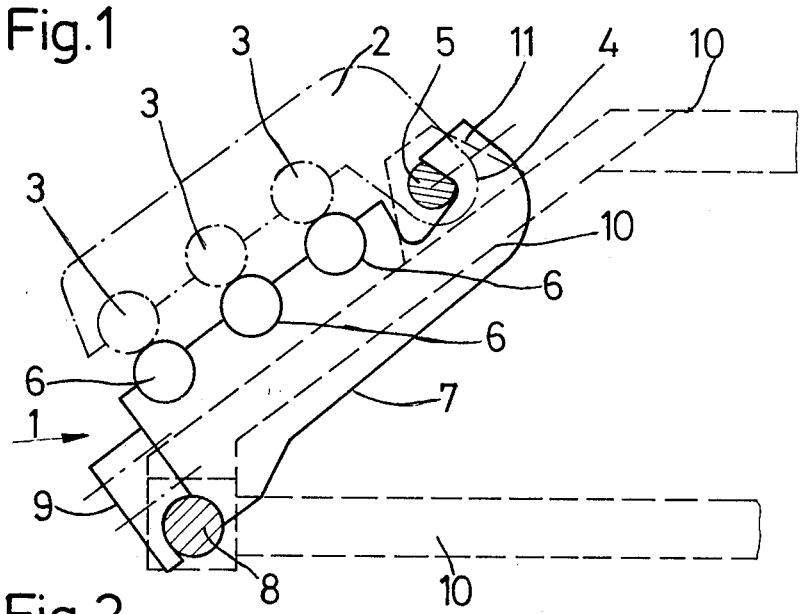
Figure 2:
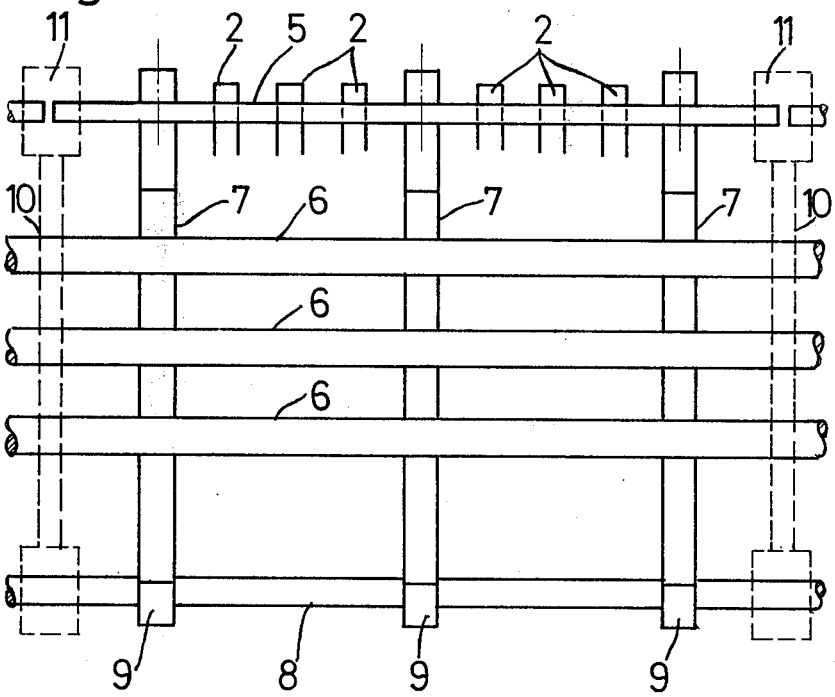
FIG. 2 shows a top view of the drawing system according to FIG. 1.

Referring now to the drawings, wherein like reference numerals designate like parts throughout the several views, FIGS. 1 and 2 show a drawing system 1, whose top roller carrying and loading arm 2, represented by the dash-dotted line, contains the top rollers 3. Top roller carrying and loading arm 2 is connected with a carrying rod 5 by means of a support 4, which is also represented by a dash-dotted line. Support 4 and top roller carrying and loadng arm 2 can be one piece, as illustrated, or support 4 can be a separate intermediate member between the carrying and loading arm. In this example, three dies 7 are preassembled on carrying rod 5, with a plurality of drawing systems 1 being arranged therebetween. A significantly greater number of dies 7 can, of course, be connected to carrying rod 5.

In addition to its attachment to carrying rod 5, each die 7, in which one bottom roller each is mounted, is also in a supporting relationship with a die carrier 8. Die carrier 8 forms a part of machine frame 10. Although free support of dies 7 on die carrier 8 would be sufficient, dies 7 are attached to die carrier 8 by means of a tensioning member 9 in order to avoid fretting corrosion and vibration. Carrying rod 5, on which a number of dies 7, corresponding to the desired section length, is arranged is attached to machine frame 10, represented by a dashed line, by means of attachment members 11, also represented by dashed lines. As can be seen from FIG. 2, the length of carrying rod 5 is at least twice as great as the distance between two adjacent dies 7.

Figure 3:
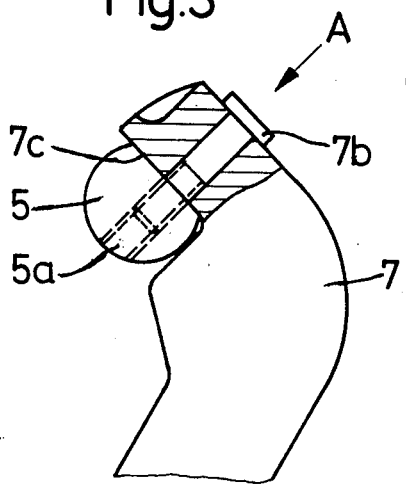
FIG. 3 shows a partial section through the point of attachment of a die to the carrying rod.
Figure 4:
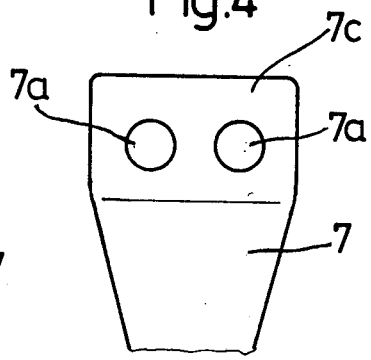
FIG. 4 shows a partial view of the die, taken in the direction of arrow A in FIG. 3.

As can be seen from FIGS. 3 and 4, in the practical example die 7 is attached to carrying rod 5 by means of screws 7*b*. Screws 7*b* are seated in holes 7*a* in die 7 and firmly screwed into threaded holes 5*a* in carrying rod 5. In this manner, dies 7 can be attached to carrying rods 5 very quickly, whereby carrying rod 5 is appropriately flattened in order to permit a good contacting relationship with the guide surfaces 7*c* of the dies.

Figure 5:
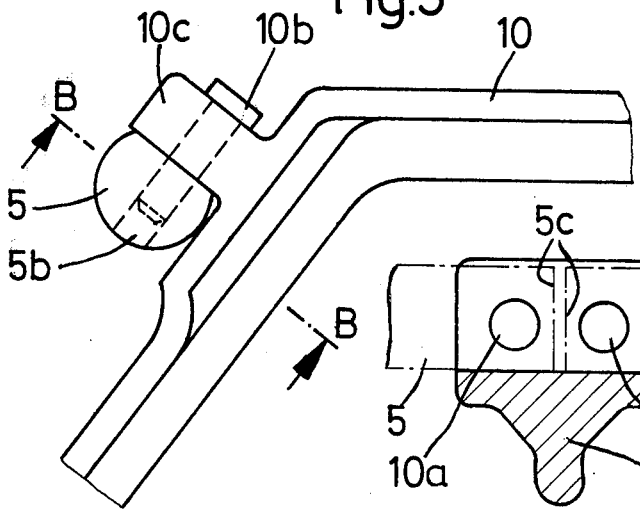
FIG. 5 shows a partial view of the attachment of the carrying rod to the machine frame.
Figure 6:
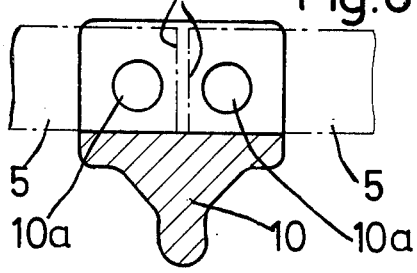
FIG. 6 shows a section through the attachment shown in FIG. 5, taken along line B - B in FIG. 5.

Carrying rod 5 itself is — as can be seen from FIGS. 5 and 6 — also attached to machine frame 10 by means of screws 10*b*; a flange member 10*c* of machine frame 10 is in a contacting relationship with the flattened area of carrying rod 5 and has holes 10*a* for screws 10*b*. As can be seen from FIG. 6, a plurality of carrying rods 5 are mounted in machine frame 10; in this drawing, two carrying rods 5, whose end surfaces 5*c* are in a contacting relationship one with the other, are represented by a dash-dotted line.

In addition to the section-wise preassembly of a carrying rod 5 with dies 7, carrying rod 5 now also becomes a supporting constructional element for the dies 7 connected therewith. This is the significant difference between the present invention and previous methods of attaching drawing systems of spinning machines.

Obviously, many modifications and variations of the present invention are possible in the light of the above teachings. It should therefore be understood that within the scope of the appended claims, the invention may be practiced otherwise than as specifically described.

Having thus fully disclosed my invention, what I claim is:

1. A drawing system for spinning machines which include a machine frame, the drawing system including top rollers and bottom rollers, arm means for carrying and loading the top rollers, a carrying rod connected to said arm means, at least two dies arranged on and connected with said carrying rod for supporting the bottom rollers, a die carrier arranged on the machine frame in a supporting relationship with said dies, said carrying rod having a length which is at least twice the distance between two adjacent dies arranged on the carrying rod, and means for directly attaching said carrying rod to the machine frame such that a surface portion of the carrying rod directly engages a surface portion of the machine frame.

2. The drawing system according to claim 1, wherein screw means are provided for connecting said dies to said carrying rod.

3. The drawing system according to claim 2, wherein said carrying rod includes a flattened surface, and wherein said dies include a surface which is in a contacting relationship with the flattened surface of said carrying rod when said dies are arranged thereon.

4. The drawing system according to claim 3, wherein said carrying rod includes a plurality of threaded holes, and wherein said surface of said dies includes a plurality of holes for receiving said screw means, said screw means extending through said holes in the die surface and engaging in the threaded holes in said carrying rod.

5. The drawing system according to claim 1, wherein screw means are provided for connecting said carrying rods to said machine frame.

6. The drawing system according to claim 5, wherein the machine frame includes flange members spaced along the machine frame, at least one hole provided in each of said flange members, said carrying rod is provided with threaded holes, said screw means extending through the holes in said flange members of the machine frame and engaging in threaded holes in said carrying rod to directly attach said carrying rod to the machine frame.

7. The drawing system according to claim 6, wherein said carrying rod includes a flattened surface, said flange members including a surface corresponding to the flattened surface, said flattened surface and said surface of the flange members being brought into a contacting relationship when said carrying rod is directly attached to the machine frame.

8. The drawing system according to claim 1, wherein said carrying rod includes a flattened surface, said dies include a surface which is in contacting relationship with the flattened surface of said carrying rod when said dies are arranged thereon.

9. The drawing system according to claim 8, wherein said carrying rod further includes a plurality of threaded holes, and wherein said dies further include a plurality of holes alignable with said threaded holes, and wherein screw means are provided for connecting said dies to said carrying rod, said screw means extending through said holes in said dies into said threaded holes.

* * * * *